United States Patent [19]

Ichioka

[11] 4,210,226

[45] Jul. 1, 1980

[54] ELEVATOR CONTROL APPARATUS

[75] Inventor: Youichi Ichioka, Inazawa, Japan

[73] Assignee: Mitsubishi Denki Kabushiki Kaisha, Tokyo, Japan

[21] Appl. No.: 916,580

[22] Filed: Jun. 19, 1978

[30] Foreign Application Priority Data

Jun. 20, 1977 [JP] Japan ..... 52-72963

[51] Int. Cl.[2] ..... B66B 5/02

[52] U.S. Cl. ..... 187/29 R; 371/68

[58] Field of Search ..... 187/29; 235/92 T, 92 PE, 235/307; 340/146.1 BE

[56] References Cited

U.S. PATENT DOCUMENTS

| | | | |
|---|---|---|---|
| 3,786,433 | 1/1974 | Notley et al. | 340/146.1 BE |
| 3,921,149 | 11/1975 | Kreis et al. | 235/307 X |
| 4,023,109 | 5/1977 | Shreve | 235/92 PE X |
| 4,049,952 | 9/1977 | Forsslund | 235/92 PE X |

*Primary Examiner*—Gene Z. Rubinson
*Assistant Examiner*—W. E. Duncanson, Jr.
*Attorney, Agent, or Firm*—Oblon, Fisher, Spivak, McClelland & Maier

[57] ABSTRACT

An elevator control apparatus and stored program system comprises an auxiliary control device together with a main control device in which a control program is stored. In the normal state, the main control device is used whereas in a fault of the main control device, the auxiliary control device is actuated to control an elevator upon detecting the fault.

2 Claims, 4 Drawing Figures

ELEVATOR CONTROL APPARATUS

BACKGROUND OF THE INVENTION

The present invention relates to an elevator control apparatus and stored program system.

It has been changed to use many semiconductor parts instead of the conventional electromagnetic relays in an elevator control apparatus for the purposes of an improvement of characteristics and a demand for a compact size and a decrease of costs.

Recently, it has been possible to supply LSI memories and LSI processers in low costs. Accordingly, it has been proposed to provide an elevator control apparatus in which an elevator control program is stored in memories and the program is processed by a program decorder to control the elevator (hereinafter referring to an elevator control apparatus in stored program system).

It is important to consider safety in the control of the elevator because of the function for carrying passengers. Moreover, it is important to prevent a stop of the operation of the elevator as far as possible because the elevator is a main transport facility in a builing.

SUMMARY OF THE INVENTION

It is an object of the present invention to provide an elevator control apparatus and stored program system which maintains safety and continues operation even though a fault of a memory or a program decorder occurs.

The foregoing object of the present invention has been attained by providing an elevator control apparatus which comprises a main control device controlling said elevator by the stored program system and having a program for generating at least one reset signal during a predetermined time;

- a timer which generates an output when counting the predetermined time and is reset by receiving said reset signal during the predetermined time to start the counting of the predetermined time;
- an auxiliary control device controlling said elevator by the stored program system as said main control device;
- a signal switching device switching a control signal of said main control device to a control signal of said auxiliary control device when said timer generates the output.

DETAILED DESCRIPTION OF THE PREFERRED EMBODIMENTS

Referring to FIGS. 1 to 4, one embodiment of the elevator control apparatus of the present invention will be illustrated.

Figure 1:
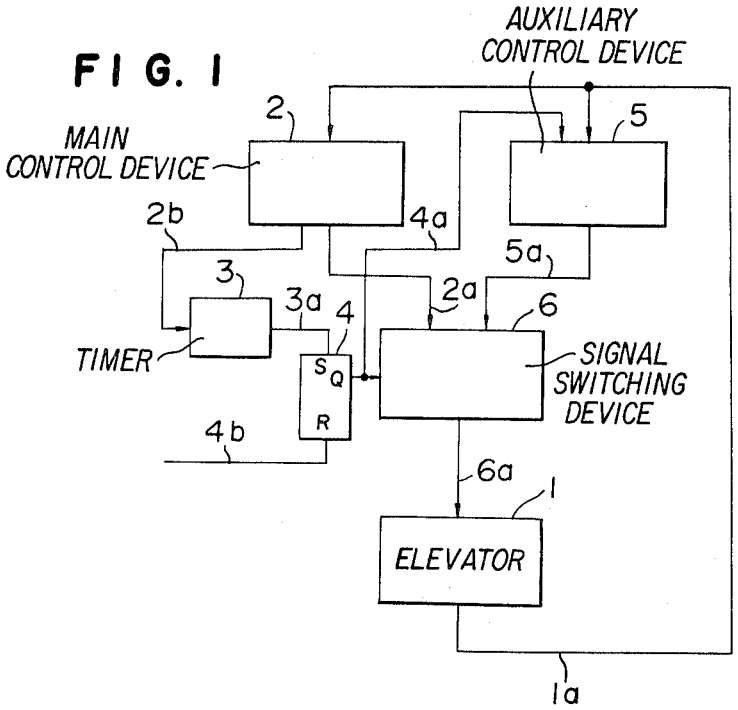
FIG. 1 is a block diagram of one embodiment of the elevator control apparatus of the present invention.

In FIG. 1, the reference (1) designates an elevator; (1*a*) designates an elevator condition signal; (2) designates a main control device in the stored program system which inputs the elevator condition signal (1*a*) to output an elevator main control signal (2*a*).

When no fault is caused in the main control device (2), at least one pulse is formed in the timer reset signal during a predetermined time t whereas when a fault is caused in the main control device (2), no pulse is formed during the predetermined time t.

The reference (3) designates a timer for the predetermined time t and the timer is reset by the pulse of the timer reset signal (2*b*). When no pulse is received during the predetermined time t, the timer (3) generates a time-out signal (3*a*).

The reference (4) designates flip-flop which is set by the time-out signal (3*a*) and is reset by an initial reset signal (4*b*) input from outside. A set output signal (4*a*) of the flip-flop (4) is referred to as an auxiliary control command signal. The reference (5) designates an elevator auxiliary control device which is actuated by the auxiliary control signal (4*a*) and inputs the elevator condition signal (1*a*) to output the auxiliary control signal (5*a*). The reference (6) designates a signal switching device which switches the control signal (2*a*) to the auxiliary control signal (5*a*) by the auxiliary control command signal (4*a*) to generate a control signal (6*a*).

The operation of the embodiment will be illustrated.

When no fault is caused in the main control device (2), at least one pulse is formed in the timer reset signal (2*b*) during the predetermined time t, whereby no time-out of the timer (3) is caused and no auxiliary control command signal (4*a*) is generated. Accordingly, the main control signal (2*a*) of the main control device (2) is given as the control signal (6*a*) by the switching device (6). That is, the elevator (1) is controlled by the main control device (2). When a fault is caused in the main control device (2), to form no pulse in the timer reset signal (2*b*), the time-out of the timer (3) is caused after the maximum time t, whereby the time-out signal (3*a*) is generated and the flip-flop (4) is set to generate the auxiliary control command signal (4*a*). The auxiliary control device (5) is actuated by the auxiliary control command signal (4*a*) and the signal switching device (6) generates the control signal (6*a*). That is, the elevator (1) is controlled by the auxiliary control device (5). The condition is continued until the flip-flop (4) is reset to eliminate the auxiliary control command signal (4*a*) by receiving the pulse of the reset signal (4*b*) from outside.

Figure 2:
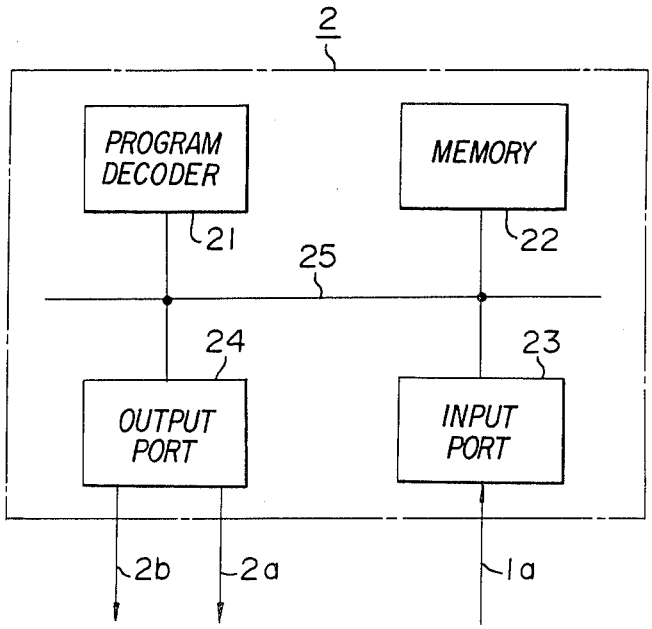
FIG. 2 is a block diagram of a main control device shown in FIG. 1.

In FIG. 2, the reference (21) designates a program decorder; (22) designates a memory; (23) designates an input port; (24) designates an output port; and the devices (21) to (24) are connected by a signal wire (25). The elevator condition signal (1*a*) is input to the input port (23) and the main control signal (2*a*) and the timer reset signal (2*b*) are output from the output port (24).

Figure 3:
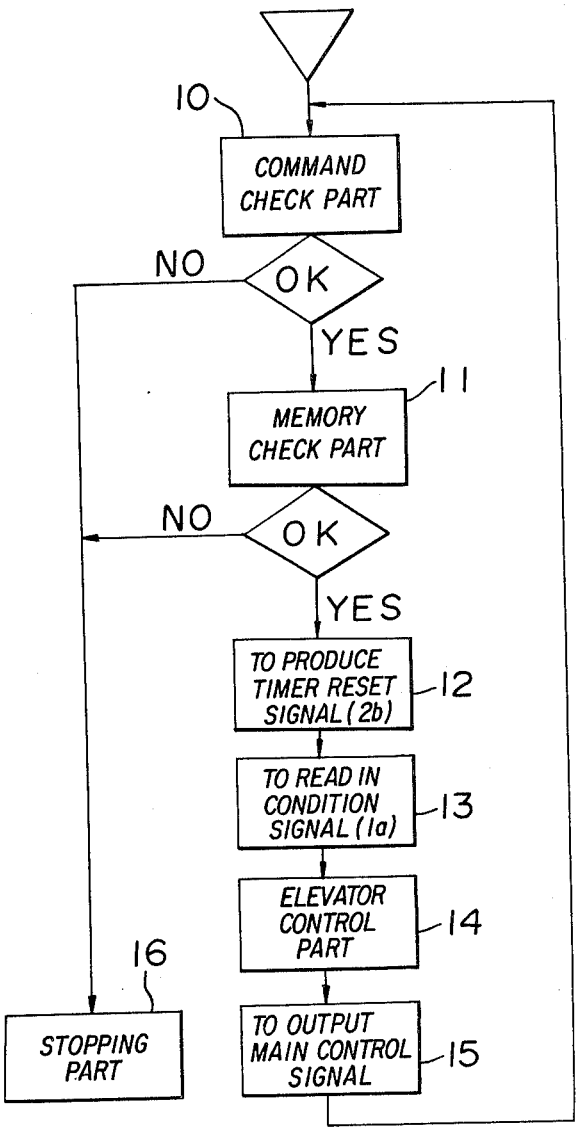
FIG. 3 is a diagram showing a program used in a program decorder shown in FIG. 2.

FIG. 3 shows a diagram of the program stored in the memory (22). The program is processed by the program decorder (21).

FIG. 3 will be further illustrated.

When the processing of the program is started, the command check part (10) is firstly processed. The command check part (10) checks whether the program decorder (21) is in the normal state or not and processes the program for the known result by using possibly all of the commands of the program decorder (21), and checks the results to give OK in the case of the same results. When the results are different, OK is not given and the signal is shunted to the stopping part (16) for stopping the processing of the program. When OK is given, the memory check part (11) is processed. The conventional parity check system has been mainly used for the check of the memories, however a complicated apparatus has been required for the parity check system.

The memories can be divided into a data area and a program area. The program area can be fixed regardless of processing of the program. Accordingly, the sum of the program memories is a constant and the program memory part can check the sum of the memories in the program area with the known value.

A single bit fault is usually caused as the fault of memory especially a semiconductor read-out only memory. Accordingly, when a fault is caused in the memory, the sum of memories is different from the known value. This is the program in the memory check part (11).

When OK is not given in the check of the sum, the signal for the program is shunted to the stopping part (16) to stop the processing of the program.

When OK is given in the check of the sum, the processing is proceeded in an operation part (12) to form the pulse in the timer reset signal (2*b*) and the elevator condition signal (1*a*) is read-in in an operation part (13) and the main control signal (2*a*) is selected in an elevator control part (14) and the main control signal (2*a*) is output from the operation part (15). The program is processed again to the command check part (10).

Thus, when OK is given in both of the command check and the memory check, the processing of the program is repeated through the memory check part (11), the operation parts (12), (13), the elevator control part (14), the operation part (15) and the command check part (10).

When the repeating period $\tau$ is shorter than the predetermined time t, at least one pulse is formed in the timer reset signal (2*b*), the time-out signal (3*a*) is not generated by the timer (3) and the elevator (1) is controlled by the main control device (2).

When a fault is caused in the command check or in the memory check, the processing of the program is stopped and no pulse is formed in the timer reset signal (2*b*).

When a fault of the main control device (2) which could not be detected by the command check part or the memory check part is caused, the period of the timer reset pulse is usually significantly deviated from $1/\tau$ and the generation of the timer reset pulse is not found in many cases. Thus, the time-out signal (3*a*) is generated by the timer (3) whereby the flip-flop (4) is set to generate the auxiliary control command signal (4*a*) and the elevator is controlled by the auxiliary control device (5).

Sometimes, the timer reset pulse is temporarily delayed from the period $\tau$, because of an intermittent fault of the main control device (2). If it is not desirable to immediately switch to the auxiliary control device (5) in such fault, it is preferable to give several times of $\tau$ as the value of $t-\tau$.

Figure 4:
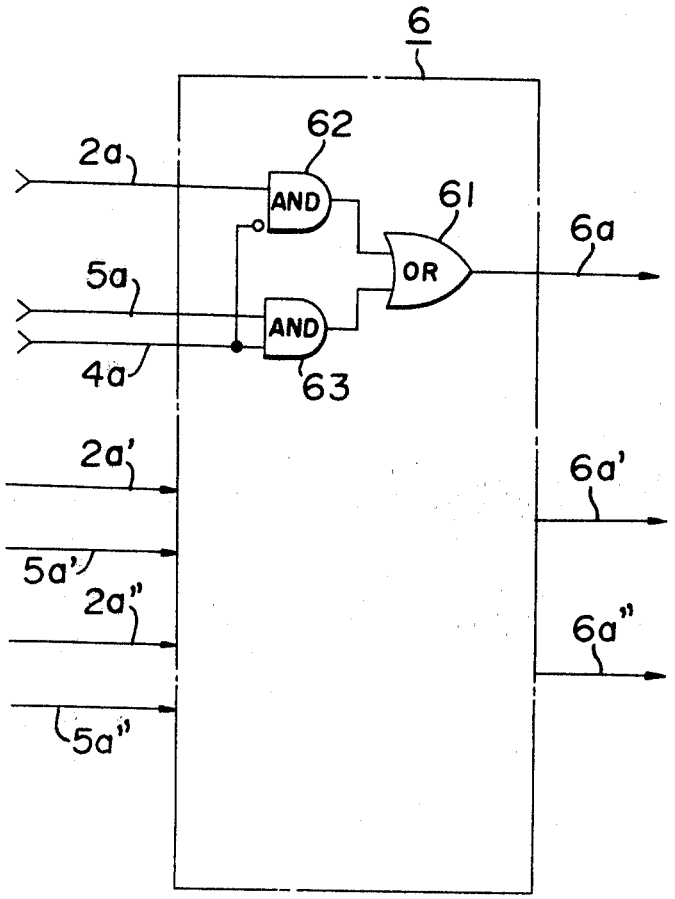
FIG. 4 is a logical circuit of a signal switching device shown in FIG. 1.

In FIG. 4, the reference (61) designates an OR gate; (62) and (63) designate AND gates and the symbol O shows the inversion of the signal.

When a non-functional auxiliary control command signal (4*a*) is fed, the auxiliary control command signal (4*a*) is not passed through the gate (63) whereas the main control signal (2*a*) is passed through the gate (62). Accordingly, the main control signal (2*a*) is applied as the control signal (6*a*).

When a functional auxiliary control command signal (4*a*) is fed, the main control signal (2*a*) is not passed through the gate (62) and the auxiliary control signal (5*a*) is applied as the control signal (6*a*).

The main control signal, the auxiliary control signal (5*a*) and the control signal (6*a*) are not respectively limited to one but can be more than one.

The following two embodiments of the present invention will be illustrated.

The control signal (6*a*) is considered to be emergency stop command signal for stopping an elevator (1) at the emergency. In this case, when a fault is caused in the main control device (2), the auxiliary control command signal (4*a*) is generated whereby the elevator (1) is stopped under an emergency stop command by the auxiliary control device (5) to maintain the safety of passengers.

The control signal (6*a*) is a direction signal for indicating the direction of the elevator; the control signal (6*a*′) is a driving signal for driving the elevator after closing the door; and the control signal (6*a*″) is a stop command signal for stopping the elevator and opening the door.

Even though a fault is caused in the main control device (2), the elevator (1) can be controlled by the outputs (5*a*), (5*a*′) of the auxiliary control device (5), whereby the elevator continues the operation without stopping the operation of the elevator (1).

It is considered to cause an abnormal condition such as the functional state or the extremely short period of the timer reset signal because of a fault of the main control device (2).

Accordingly, when the range of the period $(1/\tau_1-1/\tau_2)$ of the timer reset signal is given in the normal state of the main control device, it is possible to set the flip-flop (4) during no period of the timer reset pulse in the period $(1/\tau_1-1/\tau_2)$ under using the timer (3) as a detector for a period of the timer reset pulse signal.

As described above, in accordance with the present invention, at least one reset signal is generated from the main control device in stored program system during a predetermined time. On the other hand, the time which is reset by the reset signal to start the counting of the predetermined time, is provided and when the output is generated from the timer, the elevator is controlled after switching from the main control device to the auxiliary control device. Accordingly, even though a fault is caused in the main control device, safety can be maintained and the operation can be continued.

What is claimed is:

1. An elevator control apparatus which comprises:

main control means coupled to an elevator for producing a plurality of first elevator control signals and for periodically producing a reset signal, said main control means including a first special purpose computer device for generating said first elevator control signals and said reset signal, said first special purpose computer device including a stored elevator main control program;

auxiliary control means coupled to said elevator for producing a plurality of second elevator control signals, said auxiliary control means including a second special purpose computer device for generating said second elevator control signals, said second special purpose computer device including a stored elevator auxiliary control program;

timer means coupled to said main control means for repeatedly measuring a predetermined time period starting from the occurrence of said reset signal produced by said main control means and for generating an auxiliary control command signal upon the failure of said reset signal to reoccur prior to the end of said predetermined time period; and signal switching means interposed between the output of said main control means, the output of said auxiliary control means, and the control input of said elevator for alternatively coupling said first and said second elevator control signals to the control input of said elevator, said signal switching means being controlled by said auxiliary control command signal from said timer means.

2. An elevator control apparatus as recited in claim 1 wherein said signal switching means comprises at least one signal switching circuit, said signal switching circuit including:

first AND gate means for receiving an input signal from the output of said main control means and for receiving an input signal from said timer means, said input signal from said timer means being said auxiliary command control signal in inverted form, said first AND gate means coupling said output signal of said main control means to the output of said first AND gate means whenever said auxiliary command control signal output of said timer means is a logic "0";

second AND gate means for receiving an input signal from the output of said auxiliary control means and for receiving an input signal from said timer means, said input signal from said timer means being said auxiliary command control signal, said second AND gate means coupling said output signal of said auxiliary control means to the output of said second AND gate means whenever said auxiliary command control signal output of said timer means is a logic "1"; and OR gate means for receiving the output signals from said first AND gate means and from said second AND gate means and for coupling said output signals from said first and said second AND gate means to the control input of said elevator.

* * * * *